US008152556B2

(12) United States Patent
Wu

(10) Patent No.: US 8,152,556 B2
(45) Date of Patent: Apr. 10, 2012

(54) ELECTRIC CONNECTOR WITH ENGAGABLE STRUCTURE FOR MOUNTING MALE CONNECTOR TO FEMALE CONNECTOR

(75) Inventor: Bao-Kun Wu, Shanghai (CN)

(73) Assignees: Ambit Microsystems (Shanghai) Ltd., Shanghai (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/978,426

(22) Filed: Dec. 24, 2010

(65) Prior Publication Data

US 2012/0015542 A1 Jan. 19, 2012

(30) Foreign Application Priority Data

Jul. 15, 2010 (CN) ..... 2010 2 0259576

(51) Int. Cl.
*H01R 13/627* (2006.01)

(52) U.S. Cl. ..... 439/357

(58) Field of Classification Search ..... 439/159, 439/345, 350, 352, 353, 357, 358
See application file for complete search history.

(56) References Cited

U.S. PATENT DOCUMENTS 7,461,792 B2 * 12/2008 Lin ..... 235/492
2001/0049219 A1 * 12/2001 Torii ..... 439/352
2003/0148651 A1 * 8/2003 Shuman et al. ..... 439/358
2007/0004265 A1 * 1/2007 Yeh ..... 439/358
2007/0020986 A1 * 1/2007 Fry et al. ..... 439/357
2008/0139034 A1 * 6/2008 Dieterle et al. ..... 439/352
2008/0248680 A1 * 10/2008 Stoner et al. ..... 439/357
2008/0299811 A1 * 12/2008 Battista ..... 439/345
2009/0075507 A1 * 3/2009 Chikashige et al. ..... 439/159
2010/0159724 A1 * 6/2010 Ida et al. ..... 439/159
2011/0039433 A1 * 2/2011 Tsai ..... 439/159

* cited by examiner

*Primary Examiner* — Ross Gushi
(74) *Attorney, Agent, or Firm* — Atlis Law Group, Inc.

(57) ABSTRACT

An electric connector includes a female connector and a male connector. The female connector defines a first sliding groove, a second sliding groove parallel to the first sliding groove and a guiding slot communicating with the first sliding groove and the second sliding groove. The guiding slot includes a first guiding slot and a second guiding slot communicating the first guiding slot with the second sliding groove. The first sliding groove and the first guiding slot collectively form a step portion. The male connector includes a latching hook to engage with the first sliding groove and the second sliding groove. The latching hook slides along the first sliding groove to be received in the first guiding slot and resist on the step portion to combine the male connector with the female connector. The latching hook sides along the second guiding slot to release the male connector from the female connector.

19 Claims, 6 Drawing Sheets

ELECTRIC CONNECTOR WITH ENGAGABLE STRUCTURE FOR MOUNTING MALE CONNECTOR TO FEMALE CONNECTOR

BACKGROUND

1. Technical Field

The present disclosure relates to an electric connector, especially the electric connector with an engagable structure for mounting a male connector to a female connector.

2. Description of Related Art

Generally, an electric connector comprises a male connector and a female connector. In a typical electric connector, the male connector comprises a protruding block and the female connector defines a receiving hole to engage with the protruding block so as to engage the male connector with the female connector. However, it is difficult to release the male connector from the female connector by disengaging the protruding block from the receiving hole.

Therefore, a need exists in the industry to overcome the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
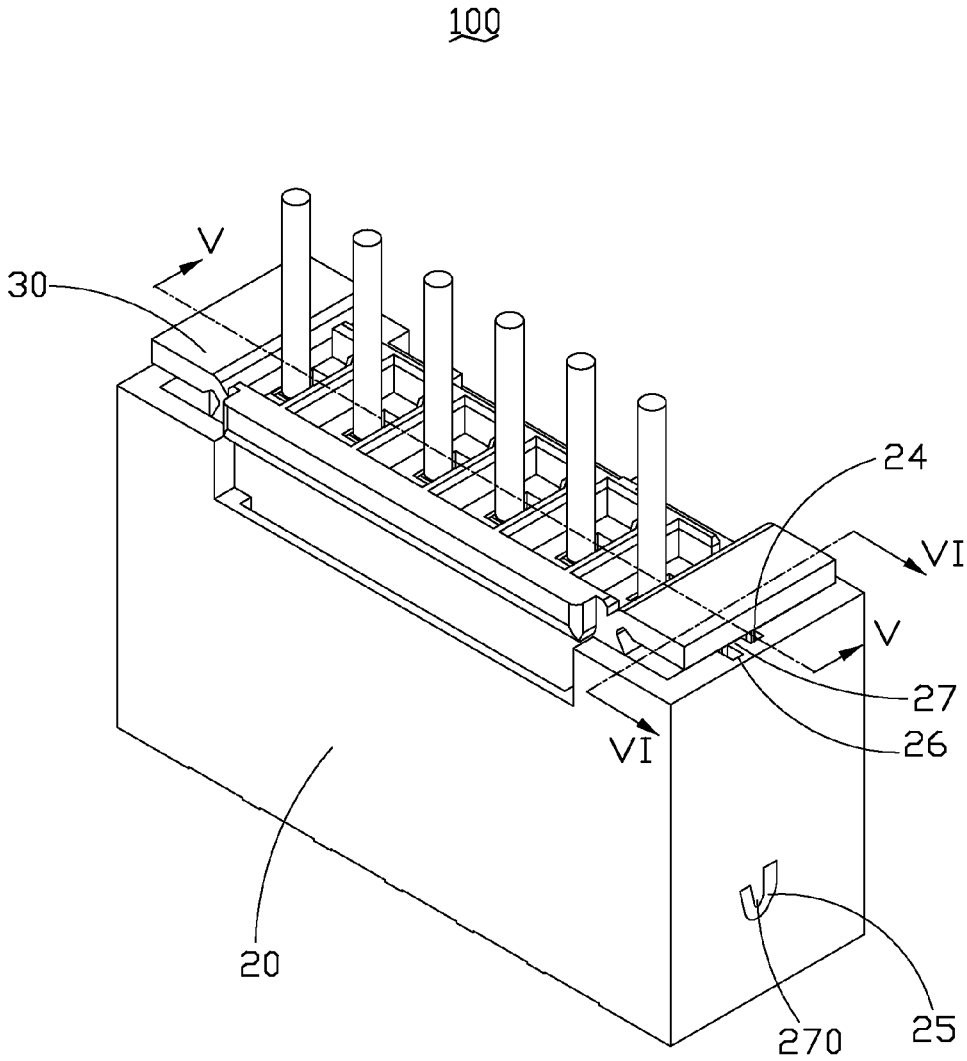
FIG. 1 is a perspective view of a preferred embodiment of an electric connector in accordance with the present disclosure.

Referring to FIG. 1, an electric connector 100 comprises a female connector 20 and a male connector 30 engagable with each other.

Figure 2:
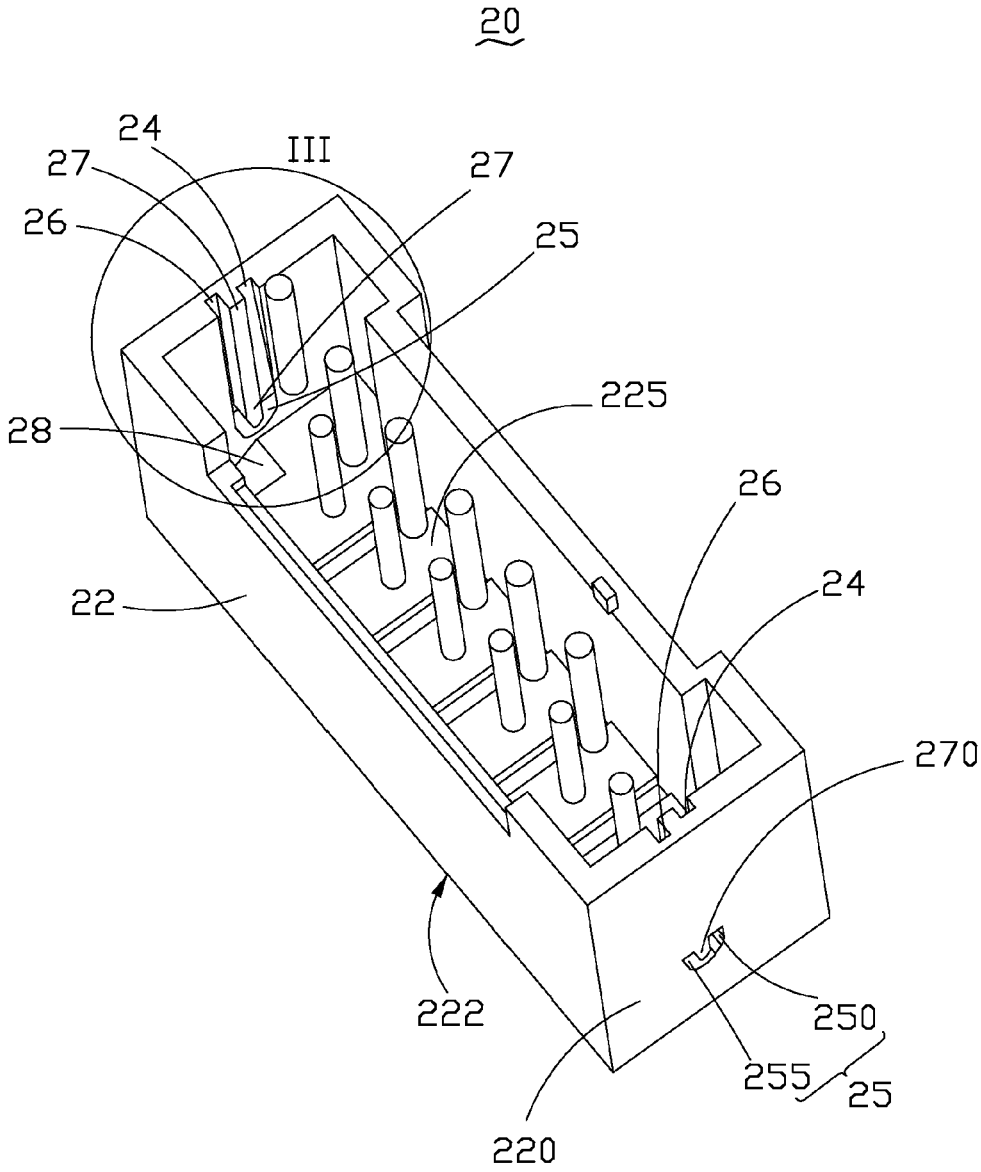
FIG. 2 is a perspective view of a female connector of the electric connector of FIG. 1.
Figure 3:
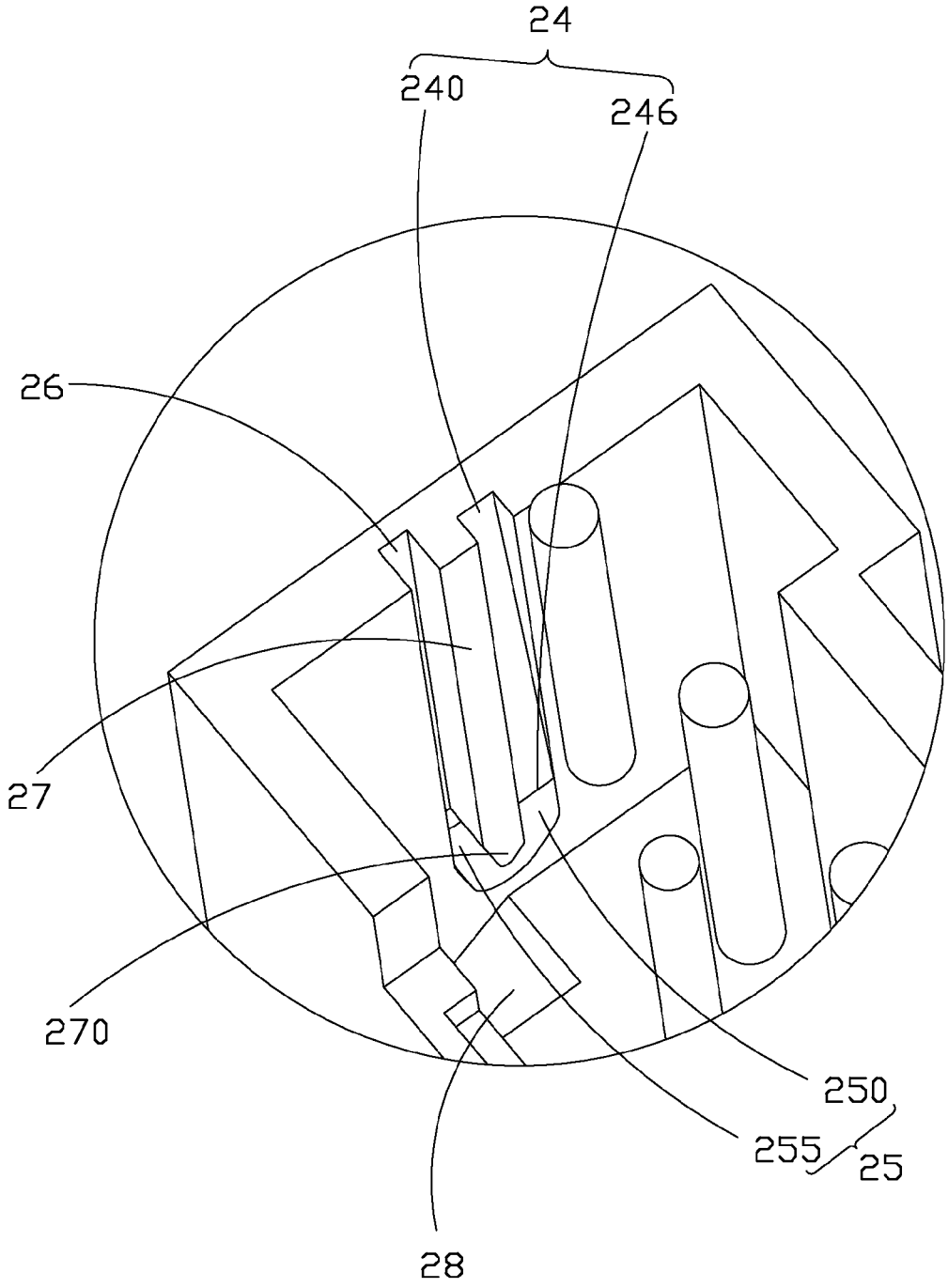
FIG. 3 is a partially perspective view of the female connector of the electric connector of FIG. 2.
Figure 4:
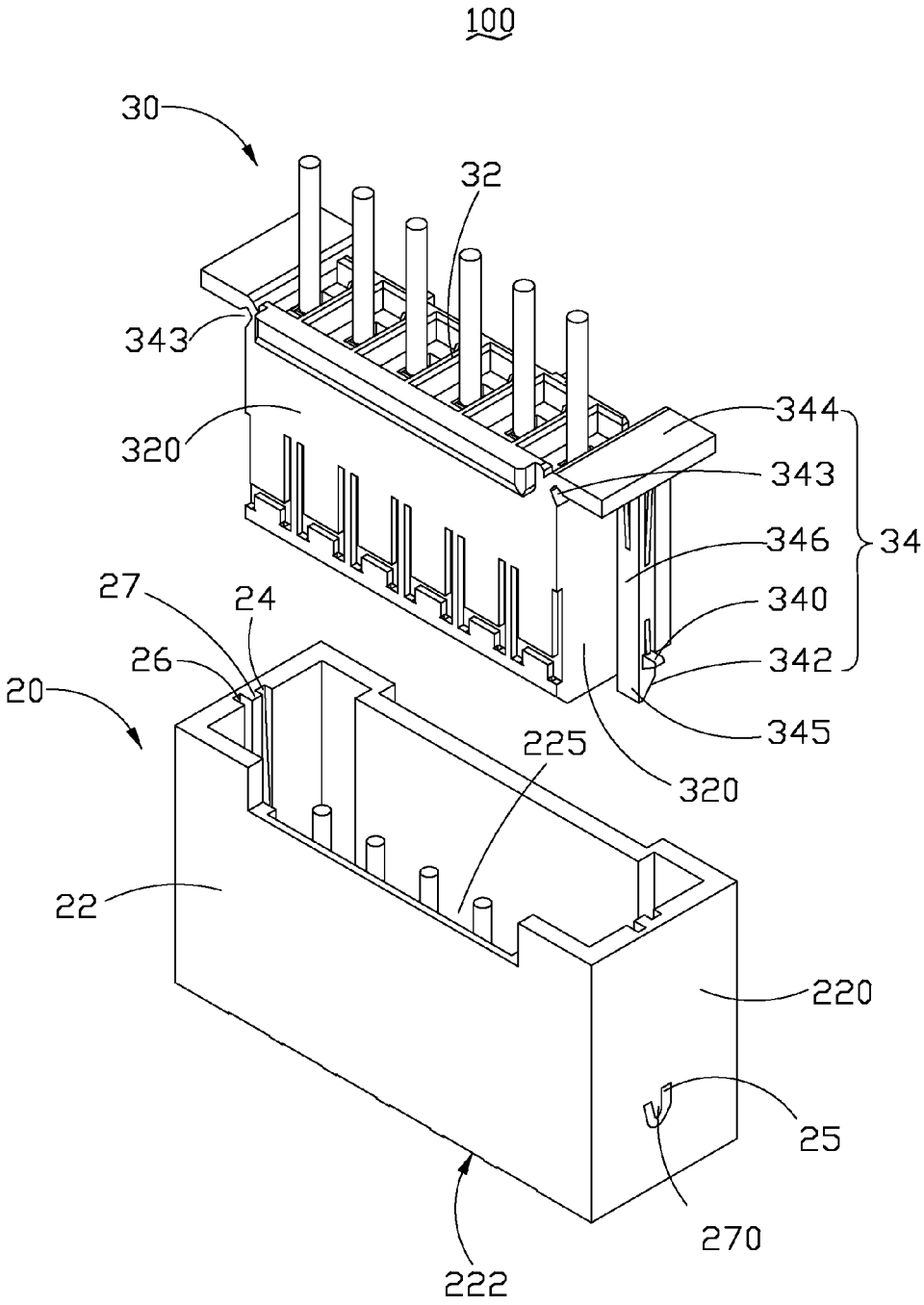
FIG. 4 is a disassembled perspective view of the electric connector shown in FIG. 1.

Referring to FIGS. 2 to 4, the female connector 20 comprises a first body portion 22. The first body portion 22 comprises a first bottom wall 222 and a plurality of first side walls 220 perpendicularly extending from edges of the first bottom wall 222. The plurality of first side walls 220 and the first bottom wall 222 cooperatively define a receiving house 225 to receive the male connector 30.

The plurality of the first side walls 220 comprise at least one arcuate protrusion 27. The arcuate protrusion 27 is formed by defining a first sliding groove 24, a second sliding groove 26 parallel to the first sliding groove 24 and a guiding slot 25 communicating the first sliding groove 24 with the second sliding groove 26. In other words, the arcuate protrusion 27 is surrounded by a U-shape slot formed by the first sliding groove 24, the second sliding groove 26 and the guiding slot 25, and protrudes towards the receiving house 225. In comparison with the first and second sliding groove 24, 26, the guiding slot 25 is close to the first bottom wall 222. The first sliding groove 24 comprises a first end 240 configured on edge of the first side wall 220 away from the first bottom wall 222 and a second end 246 contiguous with the guiding slot 25. In the illustrated embodiment, a depth of the first sliding groove 24 at the first end 240 is greater than that at the second end 246 so as to form a slope of the first sliding groove 24.

Referring to FIG. 3, the guiding slot 25 comprises a first guiding slot 250 and a second guiding slot 255. The first guiding slot 250 is contiguous with the second end 246 of the first sliding groove 24. The second guiding slot 255 communicates the first guiding slot 250 with the second sliding groove 26. The arcuate protrusion 27 comprises a bottom end 270 configured between the first guiding slot 250 and the second guiding slot 255. That is, the guiding slot 25 is substantially U-shaped and partially surrounds the bottom end 270 of the arcuate protrusion 27.

Referring to FIG. 4, the male connector 30 comprises a second body portion 32. The second body portion 32 comprises a plurality of second side walls 320 corresponding to the plurality of first side walls 220 suitable to be received in the receiving house 225 of the female connector 20.

The female connector 30 comprises at least one securing portion 34 beside the second body portion 32. The securing portion 34 engages with the corresponding first sliding groove 24 to combine the male connector 30 with the female connector 20 and engages with the corresponding second sliding groove 26 to release the male connector 30 from the female connector 20. The securing portion 34 comprises a trigger portion 344 and a securing arm 346. The trigger portion 344 extends outwardly from the second side wall 320 convenient for user operation. The securing arm 346 extends from the trigger portion 344 towards the female connector 20 and is parallel with the second side wall 320. In the illustrated embodiment, the second side wall 320 and the securing arm 346 are integrally formed with the trigger portion 344. A U-shaped groove 343 is defined at the joint of the second side wall 320 and the trigger portion 344 to improve elasticity of the trigger portion 344. The securing arm 346 is a cantilever beam with elasticity.

The securing arm 346 comprises a latching hook 340 protruding outwardly from the securing arm 346 to slide in the first sliding groove 24 and the second sliding groove 26. The second end 246 of the first sliding groove 24 and the first guiding slot 250 of the guiding slot 25 collectively form a step portion 29. In assembly, the latching hook 340 engages with the step portion 29 to securely mount the male connector 30 into the female connector 20.

Figure 6:
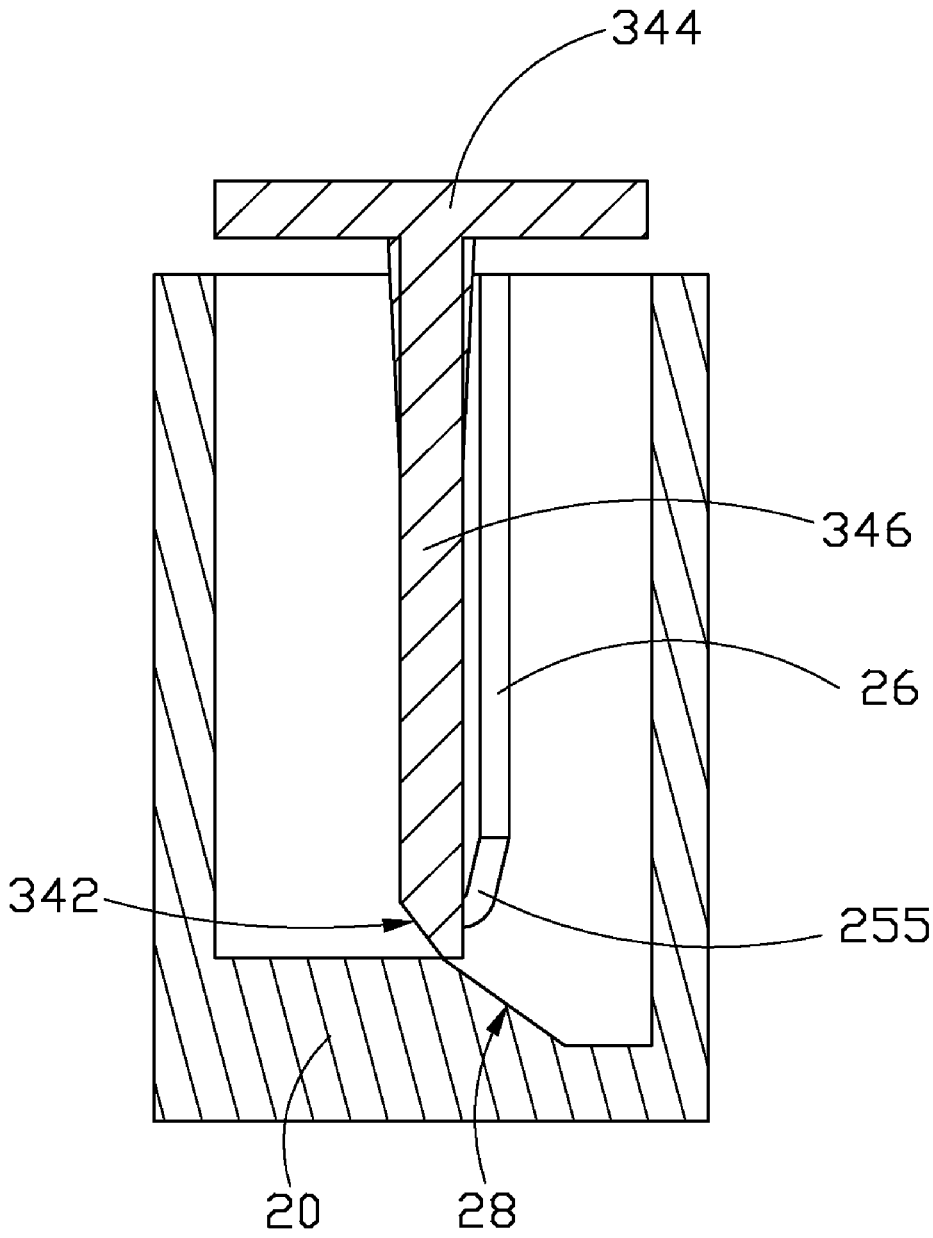
FIG. 6 is a cross-sectional view taken along line VI-VI of FIG. 1.

Referring to FIG. 6, the first bottom wall 222 of the female connector 20 comprises a pair of first slanting portions 28 near the corresponding second sliding grooves 26 relative to the corresponding first sliding grooves 24. The securing arm 346 further comprises a second slanting portion 342 on a free end 345 thereof away from the trigger portion 344. In the illustrated embodiment, the second slanting portion 342 has about a same angle of inclination with the corresponding first slanting portion 28. The second slanting portion 342 engages with the corresponding first slanting portion 28 to disassemble the male connector 30 from the female connector 20.

Figure 5:
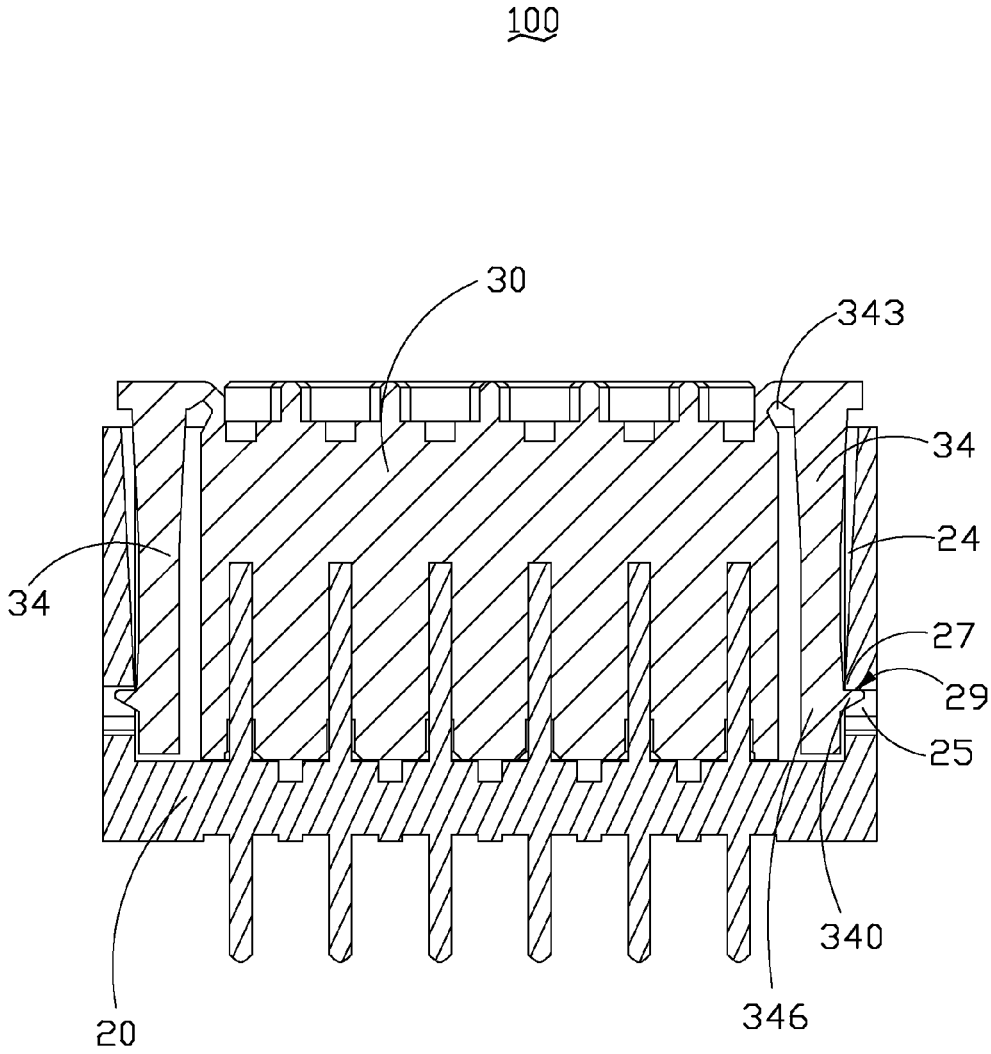
FIG. 5 is a cross-sectional view taken along line V-V of FIG. 1.

Referring to FIG. 1 and FIG. 5, when the male connector 30 matches with the female connector 20, the latching hook 340 slides along the corresponding first sliding groove 24 by inserting the second body portion 32 of the male connector 30 into the receiving portion 225 of the female connector 20. The latching hook 340 resists on the step portion 29 when the latching hook 340 received in the first guiding slot 250 of the guiding slot 25. Therefore, the male connector 30 is mounted into the female connector 20.

When triggering the trigger portion 344, the latching hook 340 moves in the first sliding slot 250 of the guiding slot 25 towards the first bottom wall 222 and rounds the bottom end 270 of the arcuate protrusion 27, simultaneously, the second slanting portion 342 moves on the first slanting portion 28 (shown in FIG. 6) to lead the latching hook 340 to slide into the second guiding slot 255. When the latching hook 340 moves into the second guiding slot 255, the male connector 30 can release from the female connector 20 due to the second guiding slot 255 communicating with the second sliding groove 26. Therefore, it is easy to engage or disengage the electric connector 100 without any tools.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. An electric connector, comprising:

a female connector, defining at least one first sliding groove, at least one second sliding groove parallel to the corresponding first sliding groove and at least one guiding slot communicating with the first sliding groove and the second sliding groove, the guiding slot comprising a first guiding slot and a second guiding slot communicating the first guiding slot with the second sliding groove, wherein the first sliding groove and the first guiding slot collectively form a step portion; and a male connector comprising at least one latching hook to engage with the corresponding first sliding groove and the corresponding second sliding groove;

wherein when the male connector matches with the female connector, the latching hook slides along the first sliding groove to be received in the first guiding slot and resist on the step portion to engage the male connector with the female connector;

when the male connector disengages from the female connector, the male connector is pressed and the latching hook slides from the first guiding slot to the second guiding slot and eventually releases from the second sliding groove.

2. The electric connector as claimed in claim 1, wherein the female connector comprises a first bottom wall and a plurality of first side walls perpendicularly extending from edges of the first bottom wall, and the first bottom wall and the plurality of first side walls cooperatively define a receiving house for receiving the male connector.

3. The electric connector as claimed in claim 2, wherein the plurality of the first side walls comprise at least one arcuate protrusion, the arcuate protrusion is surrounded by the first sliding groove, the second sliding groove and the guiding slot, and protrudes towards the receiving house.

4. The electric connector as claimed in claim 3, wherein the arcuate protrusion comprises a bottom end configured between the first guiding slot and the second guiding slot.

5. The electric connector as claimed in claim 4, wherein the guiding slot is substantially U-shaped and partially surrounds the bottom end of the arcuate protrusion.

6. The electric connector as claimed in claim 2, wherein the guiding slot is close to the first bottom wall.

7. The electric connector as claimed in claim 2, wherein the first sliding groove comprises a first end configured on edge of the first side wall away from the first bottom wall and a second end communicating with the guiding slot, a depth of the first sliding groove at the first end is greater than that at the second end so as to form a slope of the first sliding groove.

8. The electric connector as claimed in claim 7, wherein the step portion is configured at the second end of the first sliding groove to engage with the latching hook.

9. The electric connector as claimed in claim 2, wherein the male connector comprises a plurality of second side walls corresponding to the plurality of first side walls suitable to be received in the receiving house of the female connector.

10. The electric connector as claimed in claim 9, wherein the male connector comprises at least one securing portion beside the corresponding second side wall to engage with the corresponding first sliding groove and the corresponding second sliding groove.

11. The electric connector as claimed in claim 10, wherein the securing portion comprises a trigger portion extending outwardly from the second side wall.

12. The electric connector as claimed in claim 11, wherein the securing portion comprises a securing arm extending from the trigger portion towards the female connector and in parallel with the second side wall, a groove is defined at the joint of the second side wall and the trigger portion to improve elasticity of the trigger portion.

13. The electric connector as claimed in claim 12, wherein the second side wall and the securing arm are integrally formed with the trigger portion.

14. The electric connector as claimed in claim 13, wherein the securing arm is a cantilever beam with elasticity.

15. The electric connector as claimed in claim 14, wherein the latching hook protrudes outwardly from the securing arm to engage with the step portion of the female connector to securely mount the male connector into the female connector.

16. The electric connector as claimed in claim 15, wherein the first bottom wall of the female connector comprises a pair of first slanting portions near the corresponding second sliding grooves relative to the corresponding first sliding grooves.

17. The electric connector as claimed in claim 16, wherein the securing arm further comprises a second slanting portion on a free end thereof away from the trigger portion.

18. The electric connector as claimed in claim 17, wherein the second slanting portion has a same angle of inclination with the corresponding first slanting portion.

19. The electric connector as claimed in claim 18, wherein the second slanting portion moves on the first slanting portion to lead the latching hook to slide into the second guiding slot when releasing the male connector from the male connector.

* * * * *